United States Patent [19]

Russel

[11] 4,251,154

[45] Feb. 17, 1981

[54] ELECTROPHOTOGRAPHIC COLOR COPIER

[75] Inventor: Matthew J. Russel, Rochester, N.Y.

[73] Assignee: Eastman Kodak Company, Rochester, N.Y.

[21] Appl. No.: 27,976

[22] Filed: Apr. 9, 1979

[51] Int. Cl.[3] ..... G03G 15/00; G03G 15/01

[52] U.S. Cl. ..... 355/4; 355/3 TR; 355/14 TR

[58] Field of Search ..... 355/3 R, 3 TR, 3 DD, 355/3 DR, 4, 14 TR

[56] References Cited

U.S. PATENT DOCUMENTS

| | | | |
|---|---|---|---|
| 3,420,151 | 1/1969 | Levine et al. | 355/4 |
| 3,612,677 | 10/1971 | Langdon et al. | 355/4 |
| 3,642,364 | 2/1972 | Egnaczak | 355/3 |
| 3,724,943 | 4/1973 | Draugelis et al. | 355/4 |
| 3,734,607 | 5/1973 | Davis et al. | 355/4 |
| 3,775,006 | 11/1973 | Hartman et al. | 355/4 |
| 3,841,751 | 10/1974 | Draugelis et al. | 355/4 |
| 4,110,024 | 8/1978 | Gundlach | 355/3 TR |
| 4,120,577 | 10/1978 | Watanabe et al. | 355/4 |

FOREIGN PATENT DOCUMENTS

| | | |
|---|---|---|
| 923961 | 4/1973 | Canada . |
| 941229 | 2/1974 | Canada . |
| 946463 | 4/1974 | Canada . |

*Primary Examiner*—Fred L. Braun

*Attorney, Agent, or Firm*—Lawrence P. Kessler

[57] ABSTRACT

An electrophotographic apparatus for producing colored copies on a receiver sheet. A movable image transfer member, adapted to receive related transferable color separation images in nonoverlapping image areas, is moved along a transport path. A transfer mechanism is mounted adjacent to the transport path for transferring at spaced locations along the path the color separation images to a receiver sheet. The transfer mechanism successively positions the receiver sheet at the spaced locations in register with and in image transfer relation to the color separation images on the moving transfer member to superimpose the color separation images in register on the receiver sheet.

7 Claims, 1 Drawing Figure

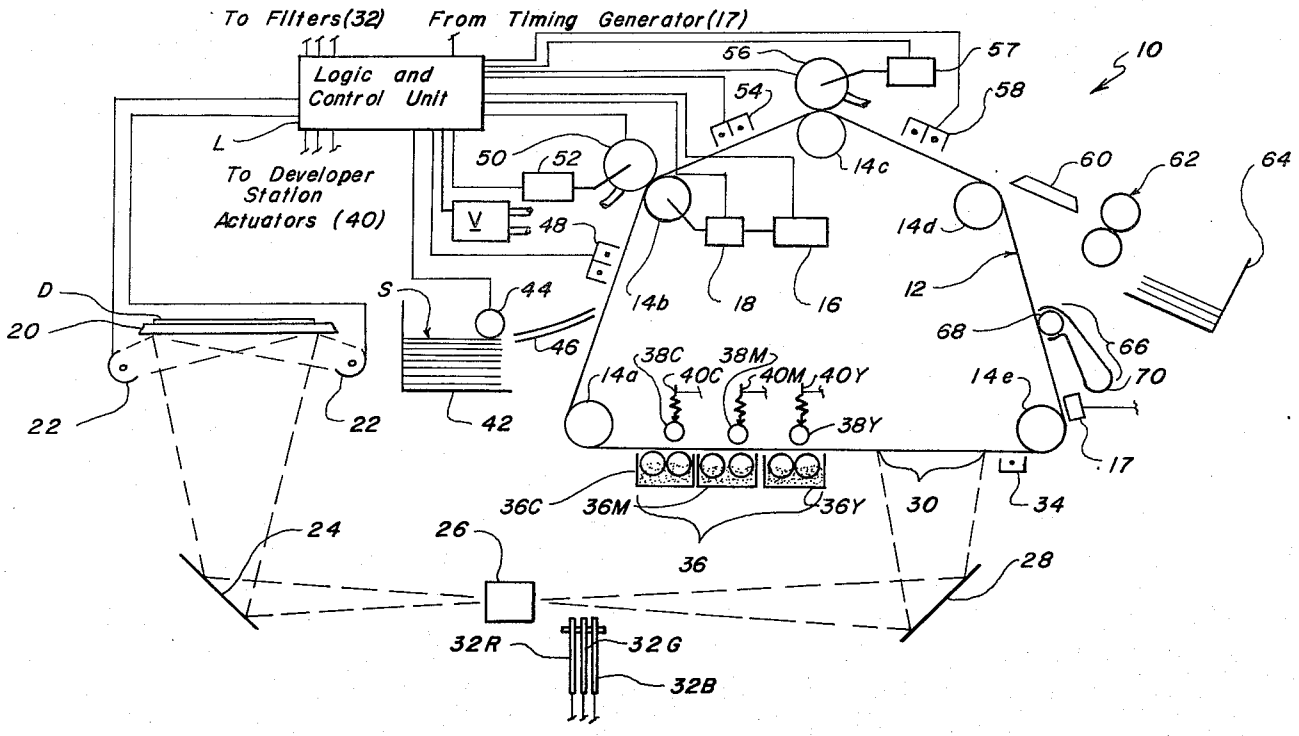
From Timing Generator (17)
To Filters (32)
Logic and Control Unit
To Developer Station Actuators (40)
L
V
S
D
10
12
14a
14b
14c
14d
14e
16
17
18
20
22
24
26
28
30
32B
32G
32R
34
36
36C
36M
36Y
38C
38M
38Y
40C
40M
40Y
42
44
46
48
50
52
54
56
57
58
60
62
64
66
68
70

ELECTROPHOTOGRAPHIC COLOR COPIER

BACKGROUND OF THE INVENTION

This invention relates generally to electrophotographic copiers, and more particularly to color copiers in which a receiver sheet is sequentially registered with successive color separation images on an image transfer member.

Electrophotography has enjoyed rapid growth as a convenient and efficient means for reproducing original documents. While most electrophotographic copiers produce black-white reproductions, the industry has recently sought to employ similar electrophotographic technology in producing color copies. Two techniques have emerged for using such technology for color copying: (1) simultaneous or (2) sequential exposure of nonoverlapping color separation images on one or more photoconductive members.

An electrophotographic apparatus utilizing simultaneous exposure techniques is shown, for example, in U.S. Pat. No. 3,690,756, issued Sept. 12, 1972 in the name of Smith. In the arrangement of FIG. 1 of the patent, the color separation images are exposed simultaneously on a corresponding number of photoconductive drums. In this arrangement, elements of the apparatus, such as the photoconductive members, are duplicative. Further, the spacing and circumferential size of the photoconductive members must be carefully selected to enable the color separation images to be transferred to the receiver sheet in properly registered superimposed relation. Alternatively, in the arrangment of FIG. 4 of the patent, the color separation images are exposed simultaneously in nonoverlapping relation on a photoconductive web. In this arrangement, the exposure area of the web is substantially larger (e.g., three times as long) than a single image exposure area with a concomitant increase in the size of the apparatus. The larger exposure area increases the complexity of the apparatus to maintain the proper location of the web in the exposure area.

Sequential image exposure is shown, for example, in U.S. Pat. Nos. 3,841,751, issued Oct. 15, 1974 in the name of Draugelis et al, and 4,120,577 issued Oct. 17, 1978 in the name of Watanabe et al. As with simultaneously exposed color separation images located in nonoverlapping relation on a photoconductive web, the receiver sheet must be re-presented to the web to transfer the images in properly registered superimposition. Re-presentation of the receiver sheet is accomplished by tacking the sheet to a roller or a belt which delivers the sheet back to the photoconductive web the number of times corresponding to the number of color separation images. The re-presenting apparatus disclosed in the U.S. Pat. No. 3,841,751 is a transfer roller to which the receiver sheet is clamped. Roller transfer apparatus typically are highly sensitive to environmental conditions and therefore difficult to control. Further, sheet clamping mechanisms are structurally complex, adding significantly to the cost of the apparatus and decreasing its reliability. The re-presenting apparatus disclosed in the U.S. Pat. No. 4,120,577 is a rotating belt which recirculates the receiver sheet. While the belt re-presenting apparatus disclosed in the U.S. Pat. No. 4,120,577 (or the roller apparatus disclosed in the U.S. Pat. No. 3,690,756) uses a more reliable corona charger, mounting of the charger within the re-presenting apparatus is difficult. Additionally, the use of a single charger for the plurality of transfer steps may require additional charger control since the different colored developer materials for developing the color separation images may have different electrical characteristics. Moreover, with a single re-presenting apparatus misalignment of the receiver sheet relative to the apparatus may be magnified on successive passes for image transfer.

SUMMARY OF THE INVENTION

This invention is directed to electrophotographic apparatus for producing colored copies on a receiver sheet. A movable image transfer member, adapted to receive related transferable color separation images in nonoverlapping image areas, is moved along a transport path. A transfer mechanism is mounted adjacent to the transport path for transferring at spaced locations along the path the color separation images to a receiver sheet. The transfer mechanism successively positions the receiver sheet at the spaced locations in register with and in image transfer relation to the color separation images on the moving transfer member to superimpose the color separation images in register on the receiver sheet.

The invention, and its objects and advantages, will become more apparent in the detailed description of the preferred embodiment presented below.

BRIEF DESCRIPTION OF THE DRAWING

In the detailed description of the preferred embodiment of the invention reference is made to the accompanying drawing, in which:

the one FIGURE is a schematic representation of a color copier including the receiver sheet registering apparatus according to this invention.

DESCRIPTION OF THE PREFERRED EMBODIMENT

In the accompanying drawing, the schematically represented color copier is designated generally by the numeral 10. The copier 10 includes a closed loop, flexible image transfer member, or photoconductive web 12. The web 12, which may be of the type described in U.S. Pat. No. 3,615,414, issued Oct. 26, 1971 in the name of Light, is supported on rollers **14*a*–14*e*. The rollers are mounted on the copier frame (not shown) with one of the rollers, for example roller 14*b*, rotatively driven by a motor 16 to effect continuous movement of the web 12 in a clockwise direction about its closed loop path. The web has a plurality of sequentially spaced, nonoverlapping image areas which pass successively through electrophotographic processing stations (charge, expose, develop, transfer, clean) located about the path of the web. The web also includes timing marks (or regularly spaced perforations) which are sensed by appropriate means, such as timing signal generator 17 to produce timing signals. Such signals are sent to a logic and control unit L, such as a Model 8080 microcomputer available from Intel Corp. of Santa Clara, California. The unit L controls the entire electrophotographic process based on the instantaneous location of the web in the travel path. An encoder 18 associated with the roller drive motor 16** also produces timing signals for the logic and control unit L. The signals from the encoder cause the unit L to fine tune the process timing.

A multicolored original document D to be reproduced is placed, image side down, on a transparent glass platen 20 supported by the copier frame. Exposure lamps 22, such as Xenon flash tubes, are located beneath the platen 20 within the frame. The lamps flood the document with light and a reflected image of the document is transmitted via mirror 24, lens 26, and mirror 28 in focus to an area 30 lying in the plane of the web 12. The original document could, of course, be a transparency illuminated from the back side thereof. The document D is illuminated, for example, three times to form three images of the document. On successive illuminations a red filter 32R, a green filter 32G, or a blue filter 32B is inserted into the light path to form color separation images at the area 30. The timing of the flash of lamps 22 and the insertion of the colored filters are controlled by the logic and control unit L and related to the travel of the web 12 to expose adjacent, nonoverlapping, areas of the web to the color separation images.

A D.C. corona charger 34, located upstream of the exposure area 30, applies a uniform electrostatic charge to the web 12 as it passes the charger and before it enters the exposure area. The photoconductive properties of the web cause the uniform charge in the exposed areas of the web to be discharged in that portion struck by the light. This forms latent imagewise charge patterns on the web in the exposed areas corresponding to the respective color separation images. Travel of the web then brings the areas bearing the latent images into a development area 36. The development area has a plurality of magnetic brush developer stations, corresponding to the number of formed color separation images, in juxtapostion to but spaced from the travel path of the web. The developer stations may be of the type described in U.S. Pat. No. 3,543,720 in the name of Drexler, et al. When the color separation images are red, green, and blue, there are three developer stations respectively containing complementary colored toner particles, i.e., cyan particles in station 36C, magenta particles in station 36M, and yellow particles in station 36Y. The toner particles, which may be of the type described in U.S. Pat. No. 4,049,447 issued Sept. 20, 1978 in the name of Azar et al, are agitated in the respective developer stations to exhibit a triboelectric charge of opposite polarity to the latent imagewise charge pattern. Backup rollers 38C, 38M, and 38Y, located on the opposite side of web 12 from the development area, are associated with respective developer stations 36C, 36M, and 36Y. Actuators 40C, 40M, and 40Y selectively move respective backup rollers into contact with the web 12 to deflect the web from its travel path into operative engagement with respective magnetic brushes. The charged toner particles of the engaged magnetic brush are attracted to the oppositely charged latent imagewise pattern to develop the pattern.

The logic and control unit L selectively activates the actuators in relation to the passage of the image areas containing corresponding latent color separation images through the development area 36. That is, as the area containing the latent red color separation image reaches the developer station 36C, actuator 40C moves the backup roller 38C to deflect the web so that the latent charge image is developed by attracting cyan toner particles from the station 36C. As soon as the image area leaves the effective development area of the station 36C, the actuator 40C returns the backup roller 38C to its nondeflecting position. Thus, as the areas containing the green and blue color separation images pass the developer station 36C, no development takes place. A similar cycle is accomplished by the logic and control unit L for the developer stations 36M and 36Y. In this manner, the red latent color separation image is developed only with cyan toner particles, the green latent color separation image is developed only with magenta toner particles, and the blue latent color separation image is developed only with yellow toner particles.

The developed color separation images must be transferred to a receiver sheet in accurately registered superimposed relation to form a full color reproduction of the original document. Such registered transfer is accomplished as follows. Receiver sheets are stored in a supply stack S supported in a hopper 42 within the copier frame. A feeder 44, such as an oscillating vacuum feeder, removes a sheet from the stack S and delivers the sheet through a guide 46 into contact with the traveling web 12. Timing of actuation of the feeder 44 is controlled by the logic and control unit L so that the fed receiver sheet reaches the web 12 with its lead edge in register with the lead edge of the area containing the first developed color separation image (e.g., cyan image). The receiver sheet travels with the web beneath a first transfer corona charger 48 located adjacent to the periphery of the web travel path on the same side of the web as the receiver sheet. The corona charger 48 has an impressed D.C. voltage sufficient to produce an ion flow which charges the receiver sheet to the extent that toner particles of the first developed image are attracted from the web to the receiver sheet.

In order to register the receiver sheet with the next developed image, the receiver sheet is removed from the web and then returned into contact with the web as the area bearing the next image reaches the location where the receiver sheet is returned to the web. Specifically, removal and return of the receiver sheet is accomplished by register means located downstream of the transfer corona charger 48. The register means may be, for example, a roller 50 in juxtapositon with the web 12. The roller 50 has a circumference equal to the dimension of one image area of the web (in the direction of web travel) plus the distance between two adjacent areas, and is rotated at an angular velocity so that the tangential velocity at the periphery of the roller equals the linear velocity of the web. Drive for the roller 50 is preferably provided by a stepper motor 52 which receives actuating signals from the logic and control unit L.

When the lead edge of the receiver sheet reaches the element of the roller 50 closest to the web, the lead edge is tacked to the roller, such as by vacuum from a vacuum source V connected to the roller and operative through ports in the roller, or any other appropriate means. The tacking action (induced by the vacuum) is controlled by the logic and control unit L so that, as the roller 50 is rotated, the receiver sheet is removed from the web 12 and rotates with the roller as the web continues to move along its travel path. Since the image bearing surface of the receiver sheet does not contact the roller, the transferred image is not disturbed by the register means. Continued movement of the web and synchronized rotation of the roller brings the lead edge of the receiver sheet back into contact with the web as the lead edge of the next image area (e.g., bearing the magenta color separation image) arrives at the recontact location. At this point in time the receiver sheet is detacked from the roller (vacuum supply inerrupted by logic and control unit L) to enable the sheet to travel with the web. In this manner, the image in the next area is in registered superimposed relation to the previously transferred image on the receiver sheet. By using a stepper motor, timing of the tacking action can be adjusted for slippage of the web 12 on the rollers 14a–14e and, rotation of the roller 50 may be adjusted via signals through the logic and control unit L from the encoder 18 to maintain the match between the tangential peripheral velocity of the roller and the linear velocity of the web. This insures that the lead edge of the receiver sheet is in register with the lead edge of the next image area of the web when the sheet is brought back into contact with the web, and the first transferred image is not disturbed by relative movement between the receiver sheet and the web.

The web and the registered receiver sheet then travel beneath a second transfer corona charger 54 located adjacent to the periphery of the web travel path on the same side of the travel path as the receiver sheet. The corona charger 54 functions, substantially in the same manner as the corona charger 48, to transfer the second developed image to the receiver sheet. The D.C. voltage impressed upon the corona charger 54 is controlled by the logic and control unit L, and may be different from the voltage impressed upon corona charger 48 depending upon the electrical characteristics of the toner particles forming the second developed image. Since the second image on the web is in register with the first image on the receiver sheet, accurate superimposed transfer of the second image onto the receiver sheet relative to the first image occurs.

As the receiver sheet and web move away from the area under the corona charger 54, the lead edge of the receiver sheet comes into contact with second register means, such as roller 56 driven by a stepper motor 57. The roller 56 and motor 57 are of identical construction to that of roller 50 and motor 52 described above and function in the same manner. The receiver sheet is thus removed from the web and returned into contact therewith by the roller 56 as the lead edge of the next image area (e.g., bearing the yellow color separation image) reaches the location where the receiver sheet is returned to the web. Therefore, the receiver sheet is in register with the next image so that a third accurate superimposed image transfer can be accomplished as the receiver sheet and web pass under a third transfer corona charger 58. As is the case with corona charger 54, corona charger 58 functions substantially the same as corona charger 48, with the impressed D.C. voltage being dependent upon the electrical characteristics of the toner particles forming the third developed image.

The order of color separation image exposure, developement and transfer is selected in order of decreasing influence on sharpness of the reproduced composite image; e.g., cyan, then magenta, then yellow. Accordingly, the three transferred images yield a sharp, full color reproduction of the original document D on the receiver sheet. The employment of three separate transfer corona chargers and separate interposed register means provides for more accurate control of image transfer and superimposed image register than prior known color copiers for better original document reproductions.

After the transfer of the third image is complete, the receiver sheet is detacked from the web 12 and moved along a path away from the web by a sheet transport apparatus such as, for example, a vacuum transport 60. The transport 60 engages the receiver sheet on the opposite side from the superimposed toner images so as not to disturb or smear the toner images. The vacuum transport 60 delivers the sheet to a fixing apparatus such as, for example, a roller fuser 62. The fuser 62 applys heat and pressure to the composite toner image and receiver sheet to fuse the toner image and permanently fix the image to the receiver sheet. The receiver sheet is then delivered to an exit hopper 64. While the image is being fixed to the receiver sheet, the web 12 continues to travel about its path through a cleaning area 66. In the cleaning area, a fur brush 68 rotating in a vacuum housing 70, for example, contacts the web to remove any residual, nontransferred toner. The web then travels back under the charger 34 where it is recharged so that the reproduction cycle can be repeated.

The invention has been described in detail with particular reference to a preferred embodiment thereof, but it will be understood that variations and modifications can be effected within the spirit and scope of the invention.

I claim:

1. In electrophotographic apparatus for producing colored copies on a receiver sheet and including a movable image transfer member adapted to receive related transferable colored toner separation images on nonoverlapping image areas and means for moving said transfer member along a transport path, the improvement comprising:

transfer means mounted adjacent to said path for transferring at spaced locations along said path the plurality of color separation images to a receiver sheet; and means operatively associated with said transfer means for successively positioning the receiver sheet at said spaced locations of said transfer means in register with and in image transfer relation to said color separation images on the moving transfer member to superimpose the color separation images in register on the receiver sheet.

2. The invention of claim 1 wherein said positioning means includes: a rotatable member in juxtaposition to the moving image transfer member, the length of the periphery of said rotatable member being equal to the combined width of an image area of said transfer member, in the direction of movement of said member, and the distance between two adjacent image areas; and means for selectively retaining said receiver sheet on said rotatable member to remove the receiver sheet from its image transfer relation with a separation image and return the sheet in register and image transfer relation to an adjacent separation image on the moving image transfer member.

3. The invention of claim 2 wherein said positioning means further includes control means for rotating said rotatable member so that the tangential velocity at the periphery of said rotatable member is equal to the linear velocity of the moving image transfer member.

4. The invention of claim 3 wherein said rotatable member is a cylinder, and said retaining means tacks a receiver sheet to said cylinder as the lead edge of the receiver sheet reaches the element of said cylinder closest to the moving image transfer member and releases the receiver sheet as the lead edge is returned into juxtaposition to said transfer member.

5. Electrophotographic apparatus for reproducing a multicolored original document on a receiver sheet using colored toner particles and including a photoconductive member defining a plurality of spaced nonoverlapping image areas, and means for moving said photoconductive member along a transport path, said apparatus comprising:

means for forming developable color separation images of an original document on adjacent image areas respectively of the moving photoconductive member;

a developer station adjacent to said transport path, said developer station being adapted to contain transferable colored toner particles complementary to said color separation images, and means for actuating said developer station to develop said color separation images with such complementary colored toner particles;

a plurality of transfer corona chargers adjacent to and individually spaced along said transport path downstream of said developer station, and means for impressing electrical potentials on said corona chargers to effect transfer of developed toner particle images to a receiver sheet to form a reproduction of the original document; and positioning means operatively associated with said corona chargers for successively positioning a receiver sheet at each of said corona chargers in register with and in image transfer relation to said developed toner particle images on adjacent image areas of the moving photoconductive member to superimpose the developed images in register on the receiver sheet.

6. The invention of claim 5 wherein said positioning means includes a rotatable member located in juxtaposition to said photoconductive member and between successive corona chargers, the length of the periphery of said rotatable member being equal to the combined width of an image area of said photoconductive member in the direction of movement of said member, and the distance between two adjacent image areas; means for rotating said rotatable member so that the tangential velocity at the periphery of said rotatable member is equal to the linear velocity of the moving photoconductive member; and means for selectively retaining said receiver sheet on said rotatable member to remove the receiver sheet from its image transfer relation with a separation image and return the sheet in register and image transfer relation to an adjacent separation image on the moving photoconductor.

7. The invention of claim 6 wherein said rotatable member is a cylinder, and said retaining means tacks a receiver sheet to said cylinder as the lead edge of the receiver sheet reaches the element of said cylinder closest to the moving photoconductive member and releases the receiver sheet as the lead edge is returned into juxtaposition to said photoconductive member.

* * * * *